US006473589B2

(12) United States Patent
Hisakuni

(10) Patent No.: US 6,473,589 B2
(45) Date of Patent: Oct. 29, 2002

(54) CLEANING DEVICE AND IMAGE FORMING APPARATUS USING THE SAME

(75) Inventor: Hisataka Hisakuni, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/921,699

(22) Filed: Aug. 6, 2001

(65) Prior Publication Data

US 2002/0041779 A1 Apr. 11, 2002

(30) Foreign Application Priority Data

Aug. 10, 2000 (JP) ..... 2000-242965

(51) Int. Cl.[7] ..... G03G 21/00
(52) U.S. Cl. ..... 399/350
(58) Field of Search ..... 15/236.01, 256.5, 15/256.53; 399/350, 351

(56) References Cited

U.S. PATENT DOCUMENTS 4,823,161 A 4/1989 Yamada et al.
5,510,887 A * 4/1996 Watabe et al. ..... 399/350
6,002,911 A * 12/1999 Suzuki et al. ..... 399/350
6,128,462 A * 10/2000 Kato et al. ..... 399/350

FOREIGN PATENT DOCUMENTS

| | | |
|---|---|---|
| JP | 56-55979 | 5/1981 |
| JP | 63-159892 | 7/1988 |
| JP | 9-218625 | 8/1997 |

* cited by examiner

*Primary Examiner*—Hoang Ngo
(74) *Attorney, Agent, or Firm*—Fitzpatrick, Cella, Harper & Scinto

(57) ABSTRACT

In a cleaning device having a cleaning blade which is abutted against an image bearing member that bears an image and cleans the surface of the image bearing member, the cleaning blade includes at least a first rubber layer which is abutted against the image bearing member; and a second rubber layer that supports the first rubber layer; wherein the tanδ peak temperature obtained by a dynamic viscoelasticity test of the first rubber layer is a value close to the surface temperature of the image bearing member; and wherein the tan δ peak temperature obtained by a dynamic viscoelasticity test of the second rubber layer is lower than the tanδ peak temperature of the first rubber layer.

27 Claims, 3 Drawing Sheets

CLEANING DEVICE AND IMAGE FORMING APPARATUS USING THE SAME

BACKGROUND OF THE INVENTION

1. Field of the Invention

The present invention relates to a cleaning device for an image forming apparatus such as an electrostatic copying machine or an electrostatic printer using an electrophotographic process and an image forming apparatus using the cleaning device.

2. Description of the Related Art

It is difficult to transfer all of the toner of a toner image formed on a surface of an image bearing member to a transferring material during transferring in an image forming apparatus, and a slight amount of toner is not prevented from remaining on the image bearing member. Also, a transferring material dust or the like which is generated when the transferring material is in contact with the image bearing member is adhered to the image bearing member. For that reason, it is necessary that the image bearing member is sufficiently cleaned to remove the toner or the transferring material dust (hereinafter they are referred to as non-transferred toner) remaining on the image bearing member even after the toner image has been transferred onto the transferring material every time the transferring operation is made.

From the above viewpoint, there have been proposed various cleaning devices up to now. Among them, a cleaning device in which an edge of a cleaning blade made of an elastic material such as rubber is abutted against the image bearing member to scrape off the non-transferred toner so that the non-transferred toner is removed is simple in the structure, low in the cost and excellent in the non-transferred toner removing function. Therefore, the cleaning device of this type has been widely put in practical use.

FIG. 5 shows the structure of a conventional cleaning device which is disposed in proximity to a rotary cylindrical image bearing member 2. The image bearing member 2 has an axial line in a direction perpendicular to a paper surface of FIG. 5, and a charger, a developing device, a transfer means and the like (not shown) are disposed in the periphery of the image bearing member 2.

The cleaning device includes a casing 14 provided with an opening portion in the direction of the image bearing member 2, and the opening portion of the casing 14 is attached with a cleaning blade 15 made of urethane rubber or the like, and an edge of a distal end of the cleaning blade 15 is abutted against the image bearing member 2.

The non-transferred toner produced at a transfer position (not shown) is scraped off by the edge of the cleaning blade 15 to clean the surface of the image bearing member 2.

Also, because the non-transferred toner that has been scraped off by the cleaning blade 15 and remains there is again supplied to the edge of the cleaning blade 15 due to the rotation of the image bearing member 2 and then interposed between the image bearing member 2 and the cleaning blade 15, the frictional force of the cleaning blade 15 is lessened, thereby being capable of obtaining a stable cleaning performance without turning up the cleaning blade 15 or the like.

Incidentally, in recent years, an intention has been made to make the particle diameter of the toner smaller and to make the fusing speed of the toner higher for the purposes of higher image quality and higher process speed. It is difficult to remove the toner of this type from the image bearing member 2, resulting in such a problem that the toner fusion band is liable to occur.

Because the non-transferred toner deteriorates the frictional force of the cleaning blade at an abutting portion (abutting nip) of the cleaning blade against the image bearing member, and, at the same time, the non-transferred toner is pressed against the image bearing member by the cleaning blade, there is a case in which the fusion bond of the toner onto the image bearing member surface occurs. Japanese Patent Application Laid-open No. 9-218625 discloses the structure in which in order to eliminate the fusion bond of the toner, the viscosity component of the viscoelasticity characteristics of the rubber material that forms the cleaning blade is increased to suppress the vibration of the cleaning blade during sliding, thereby preventing the fusion bond of the toner onto the image bearing member. More specifically, the peak temperature of tanδ obtained by the dynamic viscoelasticity test of a single-layer rubber that forms the blade is set to a value close to the photosensitive drum surface temperature.

However, in a method of increasing the viscosity component of the viscoelasticity characteristic of the single layer cleaning blade in order to prevent the fusion bond of the toner onto the image bearing member from occurring as in this structure, the deformation following property of the cleaning blade naturally obtained due to the elastic property and the force of restitution of the deformed cleaning blade become small. For that reason, with respect to the small particle diameter toner, if the viscosity component of the cleaning blade is too large for the purpose of suppressing the vibration of the blade during sliding, the cleaning performance against the non-transferred toner is degraded due to the shortage of the deformation-following property of the cleaning blade and the shortage of the force of restitution of the deformed cleaning blade, and the toner is liable to enter the interior of the nip between the cleaning blade and the image bearing member, resulting in such a problem that the toner fusion bond occurs.

Also, Japanese Patent Application Laid-open No. 56-55979 discloses a structure in which the cleaning blade is formed of an elastic rubber base and a hard synthetic resin layer to abut the hard resin layer against the image bearing member for the purpose of improving the abrasion resistance, the lubricity and the cleaning property of the cleaning blade.

However, in this structure, because the abutting portion of the cleaning blade against the image bearing member is made of a hard resin, an elastic property is very short, as a result of which there arises such a problem that the uniform abutment of the cleaning blade against the image bearing member in the longitudinal direction is difficult, a partial clearance is liable to occur, thereby being liable to cause cleaning failure.

Also, Japanese Patent Application Laid-open No. 63-159892 discloses a structure in which, in a cleaning blade formed of two layers, a rubber layer of a support portion is lower in the peak temperature of tanδ obtained by the dynamic viscoelasticity test than a rubber layer of the abutting portion against the image bearing member.

However, in the disclosure of the above publication, because the tanδ peak temperature of the rubber layer of the support portion against the image bearing member is very low to −40 to −20° C., the elastic property becomes strong when using the cleaning blade at a normal temperature with the result that the vibration of the cleaning blade is liable to occur during sliding, to thereby lead to the toner fusion bond.

SUMMARY OF THE INVENTION

The present invention has been made under the above-mentioned circumstances, and therefore an object of the present invention is to provide a cleaning device which is capable of preventing the fusion bond of the toner on the image bearing member while maintaining a high cleaning performance, and an image forming apparatus using the cleaning device.

In order to achieve the above object, according to the present invention, there is provided a cleaning device having a cleaning blade which is abutted against an image bearing member that bears an image and cleans the surface of the image bearing member, the cleaning blade comprising:

at least a first rubber layer which is abutted against the image bearing member;

and a second rubber layer that supports the first rubber layer;

wherein the tanδ peak temperature obtained by a dynamic viscoelasticity test of the first rubber layer is a value close to the surface temperature of the image bearing member;

the tanδ peak temperature obtained by a dynamic viscoelasticity test of the second rubber layer is lower than the tanδ peak temperature of the first rubber layer.

According to the present invention, because the tanδ peak temperature obtained by a dynamic viscoelasticity test of the first rubber layer is the value close to the surface temperature of the image bearing member, the cleaning blade can be used in a state where the rate of the viscosity component is the highest, and the stick-slip motion of the blade can be effectively suppressed, thereby being capable of preventing the fusion bond of the toner onto the image bearing member. In addition, because the tanδ peak temperature obtained by a dynamic viscoelasticity test of the second rubber layer is set to be lower than the tanδ peak temperature of the first rubber layer, the rate of the elasticity component of the second rubber layer becomes high, whereby the cleaning blade ensures the higher following property to maintain the higher cleaning performance.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Now, a description will be given in more detail of a preferred embodiment of the present invention with reference to the accompanying drawings.

Figure 1:
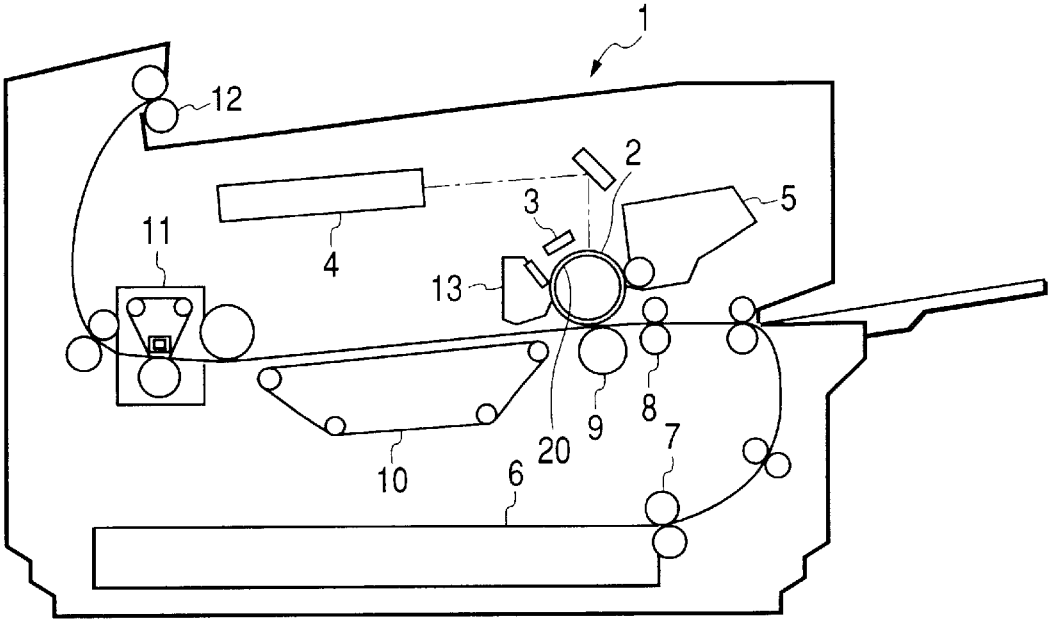
FIG. 1 is a cross-sectional view showing the outline of an image forming apparatus having a cleaning device in accordance with the present invention.
Figure 2:
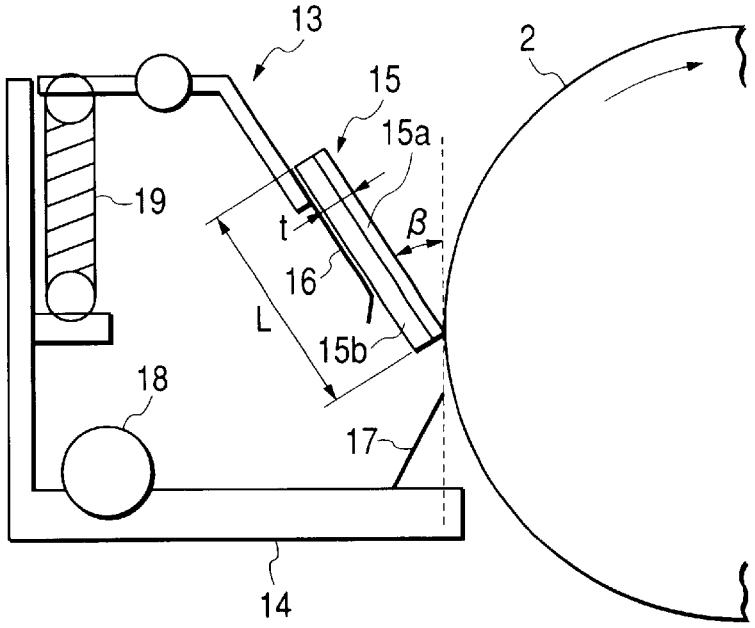
FIG. 2 is a cross-sectional view showing the cleaning device in accordance with the present invention.
Figure 3:
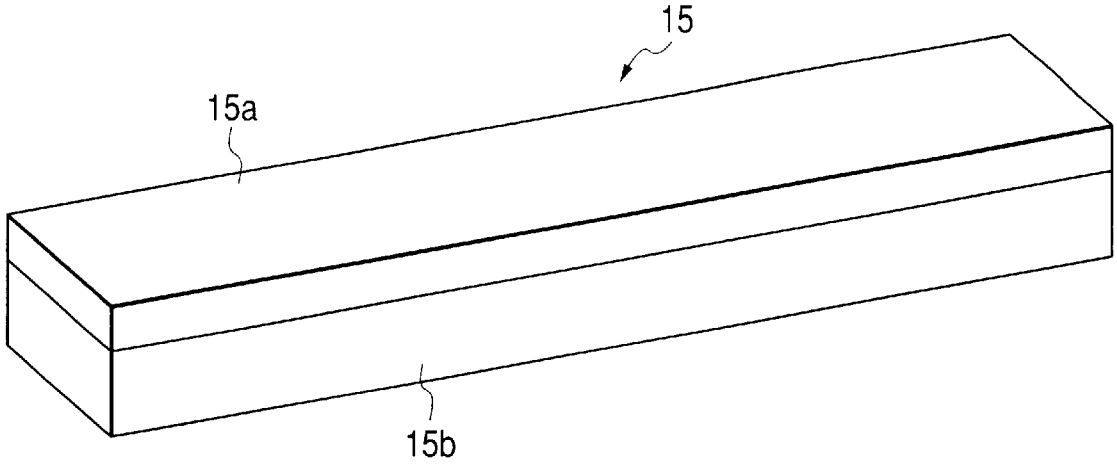
FIG. 3 is a perspective view showing a cleaning blade of the cleaning device in accordance with the present invention.
Figure 4:
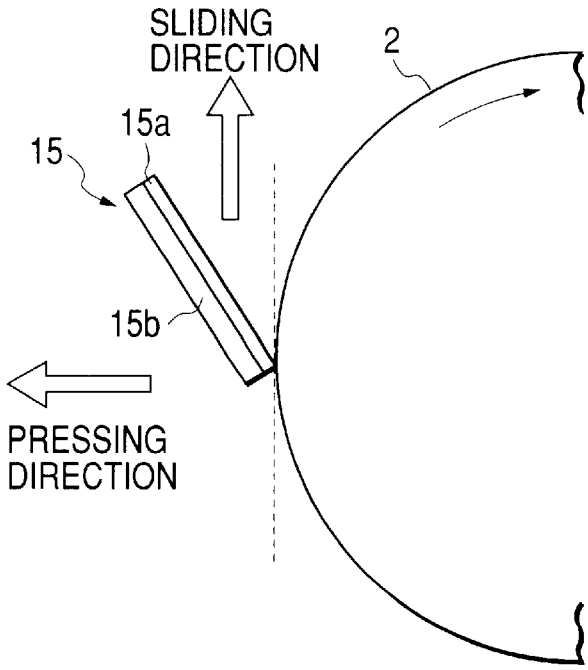
FIG. 4 is an explanatory diagram showing the operation of the cleaning device in accordance with the present invention.
Figure 5:
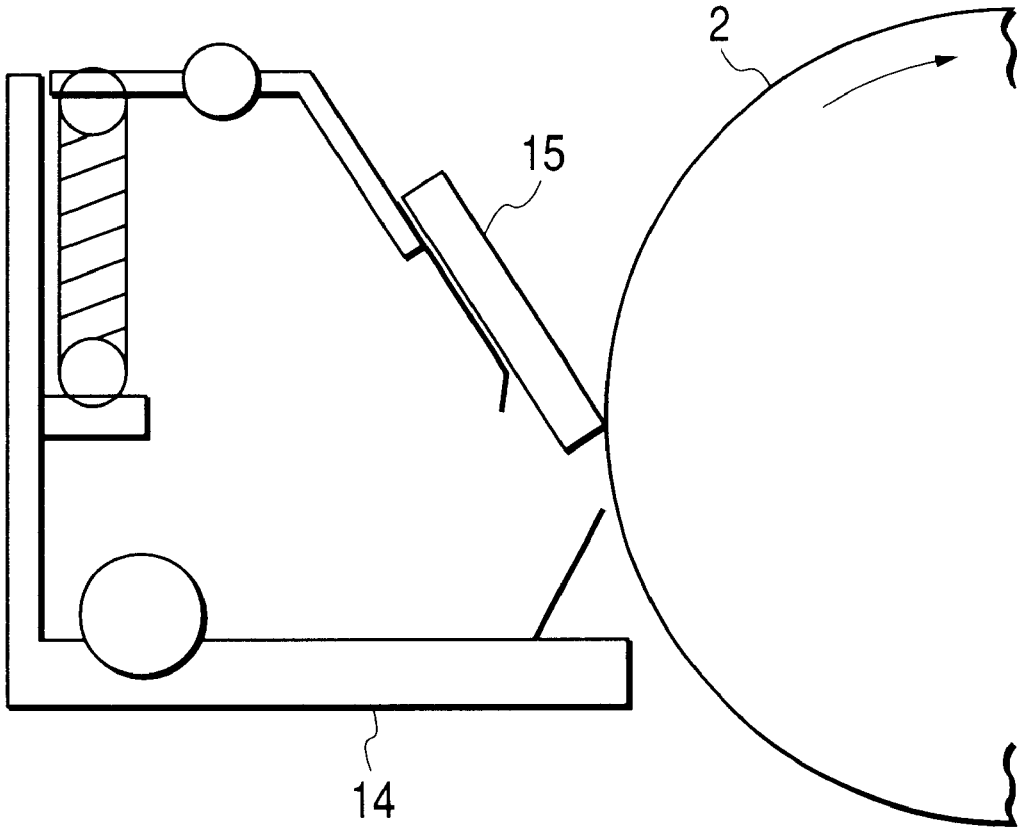
FIG. 5 is a cross-sectional view showing a conventional cleaning device.

FIG. 1 is a cross-sectional view showing the outline of an image forming apparatus having a cleaning device in accordance with the present invention, FIG. 2 is a cross-sectional view showing the cleaning device in accordance with the present invention, FIG. 3 is a perspective view showing a cleaning blade of the cleaning device in accordance with the present invention, and FIG. 4 is an explanatory diagram showing the operation of the cleaning device in accordance with the present invention.

(Image Forming Apparatus)

An image forming apparatus 1 shown in FIG. 1 is a copying machine that adopts an electrophotographic system and forms an image on a recording medium in accordance with an image signal transmitted from a computer or the like (not shown).

An image bearing member 2 of the image forming apparatus 1 is uniformly charged by a charging means 3, and a laser beam is irradiated onto the image bearing member 2 from a laser generating device 4 in accordance with an image signal. Upon the irradiation, an electrostatic latent image is formed on a portion of the image bearing member 2 onto which the laser beam is irradiated, and the electrostatic latent image is developed by the toner which is a developer by a developing device 5 and visualized as a toner image.

On the other hand, a plurality of sheets which are a recording medium are stacked in a cassette 6, and those sheets within the cassette 6 are separated one by one and fed by a feed roller 7, and then fed to the image bearing member 2 after their skew-feed is corrected by a pair of registration rollers 8.

The toner image borne on the image bearing member 2 is transferred onto the sheet by a transfer means 9, and the sheet onto which the toner image has been transferred is transported to a fixing device 11 by a transporting belt 10. Then, after the toner image has been fixed onto the sheet by a heat and a pressure by the fixing device 11, the sheet is delivered to the exterior of the apparatus by a pair of delivery rollers 12. The toner that remains on the image bearing member 2 after the toner image has been transferred onto the sheet is removed by a cleaning device 13 of the present invention, and the image bearing member 2 is again subjected to image formation.

Incidentally, the image bearing member 2 is made of various materials such as a selenium photoconductive material or an OPC (organic photoconductive material), but the effect of the present invention is great in the case of using an amorphous silicon photoconductive material whose surface is rigid. Therefore, this embodiment uses the amorphous silicon photoconductive material as the image bearing member 2. The image bearing member also includes an intermediate transfer member.

(Cleaning Device)

Subsequently, the cleaning device 13 according to the present invention will be described hereinafter.

As shown in FIG. 2, the cleaning device 13 is equipped with a casing 14 having an opening portion on the image bearing member 2 side, and a cleaning blade 15 made of a hybrid composite rubber material (polyurethane rubber) is fitted to the opening portion of the casing 14 by a support member 16. The structure of the cleaning device according to this embodiment shows one example, and the cleaning device of the present invention is not limited to this structure.

The cleaning blade 15 has one end edge thereof abutted against the image bearing member 2, and when the non-transferred toner which fails to be transferred onto the sheet by the transfer means 9 reaches the edge of the cleaning blade 15, the non-transferred toner is scrapped off by the cleaning blade 15. A dip sheet 17 which is a toner leakage preventing member is attached onto a lower portion of the casing 14, and the toner scrapped off from the image bearing member 2 by the cleaning blade 15 is allowed to be dropped down within the casing 14 by the dip sheet 17, to thereby prevent a large amount of toner from flowing backward to the image bearing member 2.

A screw 18 that serves as a transporting means for discharging the non-transferred toner is disposed within the casing 14, and the non-transferred toner that has been dropped down within the casing 14 is carried in the direction perpendicular to a drawing plane of FIG. 2 by the screw 18 and then discharged from the cleaning device 13. With this structure, there is no case in which the interior of the casing 14 is blocked by the non-transferred toner.

Incidentally, the setting of the cleaning blade 15 with respect to the image bearing member 2 is a significant factor for determining the cleaning property.

As shown in FIG. 2, as the setting conditions under which the cleaning blade 15 is abutted against the image bearing member 2, there are an abutment pressure and an abutment angle β, a free length L and the thickness t of the cleaning blade 15. In this embodiment, in order to further stabilize the abutment pressure of the cleaning blade 15 against the image bearing member 2, there is adopted a system of pressurizing the cleaning blade 15 by a spring 19. For comparison with the conventional example, the cleaning blade 15 is abutted against the image bearing member 2 by the abutment pressure of 25 gf/cm, and the thickness t of the cleaning blade 15 is set to 3 mm, and the free length L is set to 5 mm. Alternatively, the image bearing member may be pressurized by using an elastic force of the blade per se without using the spring 19.

The cleaning blade 15 used in this embodiment consisting of a cleaning portion 15*a* and a support portion 15*b*, which is made up of two layers in the thickwise direction. In this example, the cleaning portion 15*a* and the support portion 15*b* that constitute the cleaning blade 15 are made of polyurethane rubber, and as a result of measuring the physical value of the polyurethane rubber by a vulcanized rubber testing method of JIS, the A hardness is 70° C.

It is preferable that the material of the cleaning blade 15 is polyurethane rubber having polyester polyol as a molecular skeleton from the viewpoint of the abrasion resistance, for example, adipate type or lactone type polyol or polyol of those mixture, polyisocianates, glycols as a chain enlongator, amines, multifunctional polyols as a cross-linker, or polyamines. Polyurethane that satisfies a desired blade function is molecularly designed and synthesized, and molded into a blade shape to be used as the material of the cleaning blade 15.

Also, the cleaning portion 15*a* and the support portion 15*b* that constitute the cleaning blade 15 may be, for example, molded through an integral heat molding, or stuck onto each other by a normal adhesive.

In addition, the hardness of the polyurethane rubber is so set as to push the cleaning blade 15 against the image bearing member 2 under a predetermined pressure by a predetermined distance and a load or more from the viewpoint of the cleaning property of the non-transferred toner. However, if the hardness is extremely low, the pressure is short and the elasticity of the rubber is weakened so that the cleaning blade 15 comes in contact with the image bearing member 2 over the large surface. As a result, because the frictional force during sliding increases to deteriorate the sliding property, the hardness of 40° or more in JIS-A is preferable. Conversely, if the hardness of the cleaning blade 15 is extremely high, the surface of the image bearing member 2 may be damaged. As a result, the hardness should be set to preferably 90° or less in JIS-A, more preferably 50° to 80° in JIS-A.

Also, the peak temperature of tanδ was measured by using a dynamic viscoelasticity tester.

In this example, the tanδ, which is one of the physical values of the rubber material, is a numeric value obtained through the dynamic viscoelasticity test complying with JIS-K 7198 and is a value (=E"/E') resulting from dividing the viscosity component of the rubber material (loss modulus En) by the elasticity component (storage modulus E').

If the tanδ is larger, the viscosity component is large, and the rubber material exhibits a characteristic excellent in the vibration attenuation property, and if the tanδ is smaller, the elasticity component is larger, and the rubber material exhibits a more elastic characteristic.

When the rubber material rises from a low temperature region to a high temperature region, both of the storage modulus E' and the loss modulus E" are lessened, and the rubber material changes from a glass state to a rubber state. With this change, the tanδ exhibits a peak at a temperature where the storage modulus E' and the loss modulus E" approach the most to each other. That is, the upper side (high temperature side) of the tanδ peak temperature is a region strong in the elastic property and the lower side (low temperature side) is a region strong in non-elastic property in the rubber material.

In the measurement of the tanδ peak temperature, a dynamic viscoelasticity measuring device RSAII (software; Rhios) made by Rheometric Fareast Inc. is used, and a rubber test piece (section: 1.5 mm×6 mm, length: 22.5 mm) is fixed to the measuring device at a position of 6 mm from both sides thereof, and a tension of a constant load (200 gf) is applied to the rubber test piece, and a strain is applied onto the test piece at a frequency of 10 Hz, and a stress developed on the test piece is measured. The measured stress is decomposed into an elastic stress and a viscosity stress, from which the storage modulus E' and the loss modulus E" are calculated, and a value E"/E' obtained by dividing E" by E' is obtained as tanδ. Then, the tanδ values at the respective temperatures are measured while the temperature rises 1° C./min from a lower temperature region to a higher temperature region, and a temperature indicating the maximum is set as the tanδ peak temperature. Also, the strain applied to the rubber test piece is generated by applying the tension of ±a (gf) to the tension of 200 gf which is applied in advance in a period of 10 Hz, and the value of a(gf) is changed depending on the measurement temperature and set by an auto-strain mode.

In this embodiment, the operation of the cleaning device 13 in accordance with the present invention will be described with reference to FIG. 4.

A tangent direction (sliding direction) of a portion of the cleaning blade 15 which is abutted against the image bearing member 2 and a normal direction (pressing direction) along which the cleaning blade 15 is pressed against the image bearing member 2 will be described, separately.

The cleaning portion 15*a* of the cleaning blade 15 which is abutted against the image bearing member 2 has a property that the rate of the viscosity component in the viscoelasticity characteristics is the highest because the tanδ peak temperature is close to the surface temperature of the image bearing member 2. As a result, because the period and the amplitude of the stick slip motion caused by the frictional force that is exerted in the tangent direction of the image bearing member 2 which occurs when the image bearing member 2 and the cleaning blade 15 slide are small, it is difficult to nip the toner in the abutting nip between the image bearing member 2 and the cleaning blade 15, thereby making it hard to cause the toner fusion bond, and also even if the toner fusion bond occurs, because the scrape-off property due to the cleaning blade 15 is high, the toner can be immediately removed.

Also, because the support portion 15*b* that presses the cleaning blade 15 against the image bearing member 2 is set to be lower in the tanδ peak temperature than the cleaning portion 15*a,* the viscosity component in the viscoelasticity characteristic is reduced to increase the elastic component, and because the following property with respect to the leap-up of the cleaning blade 15 in the pressing direction which is the normal direction of the image bearing member 2, which occurs when the frictional force occurring at the time of sliding the image bearing member 2 and the cleaning blade 15 is extremely large, is high, the cleaning blade 15 is restored immediately, thereby being capable of obtaining excellent cleaning performance.

It is desirable that the image bearing member of the present invention is formed of an amorphous silicon photoconductive member which is very hard because the lifetime is long and the surface of the image bearing member 2 can be strongly scraped off.

Also, the provision of a device that adjusts the surface temperature of the image bearing member 2 to a constant value makes it possible to obtain the effects of the present invention without taking the environmental temperature at which the device is used into consideration. As the regulating device of the surface temperature, for example, as shown in FIG. 1, there is a system in which a cylindrical sheet heater 20 that functions as a temperature control means is disposed in an inner surface portion of the image bearing member to adjust the temperature to a given temperature. However, the present invention is not limited to this system.

(First Embodiment)

In this embodiment, a durability test of 100,000-sheet supply was conducted in a state where the surface temperature of the image bearing member 2 is close to the atmospheric temperature at an ordinary temperature and an ordinary humidity (24° C. in temperature and 55% in relative humidity) using the copying machine (trade name: NP6060 (manufactured by Canon) having the cleaning device 13 of the present invention shown in FIG. 1. The result of conducting the image evaluation is shown in Table 1.

TABLE 1

| | Embodiment 1 | Embodiment 2 |
|---|---|---|
| Cleaning blade tanδ peak temperature | Cleaning portion 20° C. Support portion 5° C. | Cleaning portion 35° C. Support portion 5° C. |
| Image bearing member surface temperature | 24° C. (Environmental temperature) | 40° C. |
| Toner fusion bonding | No occurrence | No occurrence |
| Cleaning failure | No occurrence | No occurrence |

| | Comp. Example 1 | Comp. Example 2 | Comp. Example 3 |
|---|---|---|---|
| Cleaning blade tanδ peak temperature | Single layer 35° C. | Single layer 5° C. | Cleaning portion 5° C. Support portion 35° C. |
| Image bearing member surface temperature | 40° C. | 40° C. | 40° C. |
| Toner fusion bonding | No occurrence | Occurrence in case of 50,000 sheets or more | Occurrence in case of 30,000 sheets or more |
| Cleaning failure | Occurrence in case of 70,000 sheets or more | No occurrence | Occurrence in case of 10,000 sheets or more |

As shown in Table 1, with the use of the cleaning blade 15 according to the present invention, no toner fusion bonding occurs on the image bearing member 2 because the peak temperature of tanδ on the cleaning portion 15*a* of the cleaning blade 15 is close to the environmental atmospheric temperature which is the surface temperature of the image bearing member 2. In this embodiment, the tanδ peak temperature of the rubber material of the cleaning portion 15*a* of the cleaning blade 15 is set within ±5° C. with respect to the surface temperature of the image bearing member 2.

Also, because the tanδ peak temperature of the support portion 15*b* that presses the cleaning blade 15 against the image bearing member 2 is low, the following property to the deformation due to the frictional force occurring due to the rubbing of the image bearing member 2 and the cleaning blade 15 is high, thereby being capable of excellently removing the non-transferred toner over a long period of time for cleaning.

(Second Embodiment)

In this embodiment, there is used the cleaning blade 15 made of polyurethane rubber in which the physical value of the rubber material of the cleaning portion 15*a* of the two-layer structure of the cleaning blade 15 is 70° in JIS-A hardness and 35° C. in tanδ peak temperature, and the physical value of the rubber material of the support portion 15*b* is 70° in JIS-A hardness and 5° C. in tanδ peak temperature. Also, the surface temperature of the image bearing member 2 is controlled to 40 to 45° C. by using the heater 20 within the image bearing member 2. Except for the above conditions, the experiment was conducted with conditions identical with those in the first embodiment.

The image evaluation results due to the sheet supply durability of 100,000 sheets using the copying machine so as to control the surface temperature of the image bearing member 2 as in the first embodiment using the cleaning blade 15 shown in this embodiment are shown in Table 1.

As is apparent from Table 1, even in this embodiment, no toner fusion bonding occurs on the image bearing member 2 as in the first embodiment, and the non-transferred toner can be excellently removed for cleaning. Also, the effects of this embodiment is exhibited not depending on the temperature characteristic of the rubber material by controlling the surface temperature of the image bearing member 2 even in the case where the environmental temperature is high.

COMPARATIVE EXAMPLE 1

In this comparative example, the cleaning blade 15 is formed of a single layer, and the physical values of the rubber material is controlled such that the rubber hardness is 70°, the tanδ peak temperature is 35° C. and the surface temperature of the image bearing member 2 is 40 to 45° C.

The image evaluation results in the case of conducting the sheet supply durability of 100,000 sheets by the copying machine using the structure of this comparative example as in the first embodiment are shown in Table 1. In this comparative example, because the tanδ peak temperature of the rubber material of the cleaning blade 15 is close to the surface temperature of the image bearing member 2, no toner fusion bonding occurs on the image bearing member 2. However, because the elastic property is short, the following property is low, and the cleaning failure occurs because the non-transferred toner is not completely removed for cleaning.

COMPARATIVE EXAMPLE 2

In this comparative example, the cleaning blade 15 formed of a single layer is used as in the comparative example 1, and the physical values of the rubber material are controlled such that the rubber hardness is 70°, the tanδ peak temperature is 5° C., and the surface temperature of the image bearing member 2 is 40 to 45° C.

The image evaluation results in the case of conducting the sheet supply durability of 100,000 sheets by the copying machine using the structure of this comparative example as in the first embodiment are shown in Table 1. In this comparative example, because the tanδ peak temperature of the rubber material of the cleaning blade 15 is lower than the surface temperature of the image bearing member 2, the effect of removing the non-transferred toner is high, and no cleaning failure occurs. However, because the viscosity property is short, the toner fusion bonding occurs.

COMPARATIVE EXAMPLE 3

In this comparative example, the cleaning blade 15 formed of two layers is used as in the second embodiment, and the surface temperature of the image bearing member 2 is controlled to 40 to 45° C. The rubber physical values of the cleaning portion 15*a* of the cleaning blade 15 formed of two layers are set to 70° in hardness and 5° C. in the tanδ peak temperature.

The image evaluation results in the case of conducting the sheet supply durability of 100,000 sheets by the copying machine using the structure of this comparative example as in the first embodiment are shown in Table 1. In this comparative example, both of the toner fusion bonding and the cleaning failure are deteriorated. The reasons that the cleaning failure is liable to occur are that the tanδ peak temperature of the rubber material of the support portion 15*b* of the cleaning blade 15 that presses the edge that scrapes off the surface of the image bearing member 2 is high, the elastic property is short, and it is difficult to restore the deformation of the cleaning blade 15 in the pressing direction due to the frictional force of the image bearing member 2 and the cleaning blade 15, and therefore the toner is readily stored, and the abutment pressure of the cleaning blade 15 against the image bearing member 2 becomes nonuniform with the result that the cleaning failure is liable to occur.

Also, as described above, because the cleaning failure is liable to occur, the cleaning blade 15 presses the toner against the image bearing member 2 so that the toner fusion bonding is liable to occur, and in addition, because the tanδ peak temperature of the rubber material of the cleaning portion 15*a* is low, the viscosity property is short, and the effect of preventing the toner fusion bonding on the surface of the image bearing member 2 is low, and it is presumed that the toner fusion bonding is liable to occur for that reason.

As was described above, according to the present invention, because the tanδ peak temperature obtained by the dynamic viscoelasticity test of the first rubber layer is set to a value close to the surface temperature of the image bearing member, the cleaning blade can be used in a state where the rate of the viscosity component is the highest, and the stick slip motion of the blade is effectively suppressed, thereby being capable of preventing the toner fusion bonding on the image bearing member. In addition, because the tanδ peak temperature obtained by the dynamic viscoelasticity test of the second rubber layer is lower than the tanδ peak temperature of the first rubber layer, the second rubber layer is high in the rate of the elasticity component, and the high following property is ensured for the cleaning blade, thereby maintaining the high cleaning performance.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A cleaning device comprising:

a cleaning blade, which is abutted against an image bearing member, which bears an image, said cleaning blade cleaning a surface of the image bearing member, said cleaning blade including at least a first rubber layer, which is abutted against the image bearing member, and a second rubber layer, which supports said first rubber layer, wherein a tanδ peak temperature obtained by a dynamic viscoelasticity test of said first rubber layer is a value close to a surface temperature of said image bearing member, and a tanδ peak temperature obtained by a dynamic viscoelasticity test of said second rubber layer is lower than the tanδ peak temperature of said first rubber layer.

2. A cleaning device according to claim 1, wherein said first rubber layer and said second rubber layer are made of polyurethane rubber.

3. A cleaning device according to claim 2, wherein a JIS-A hardness of said first rubber layer and said second rubber layer is in a range of 40° to 90°.

4. A cleaning device according to claim 2, wherein a JIS-A hardness of said first rubber layer and said second rubber layer is in a range of 50° to 80°.

5. A cleaning device according to claim 1, wherein said cleaning blade is made by integrally forming said first rubber layer with said second rubber layer.

6. A cleaning device according to claim 1, wherein said cleaning blade is made by bonding said first rubber layer and said second rubber layer.

7. A cleaning device according to claim 1, further comprising temperature control means for controlling the surface temperature of said image bearing member to a predetermined temperature.

8. A cleaning device according to claim 1, wherein the tanδ peak temperature of said first rubber layer is within ±5° C. of the surface temperature of said image bearing member.

9. A cleaning device according to claim 8, wherein a rubber material to make the tanδ peak temperature of said first rubber layer fall within ±5° C. of the surface temperature of said image bearing member is used in said first rubber layer.

10. A cleaning device according to claim 1, wherein said image bearing member is formed of an amorphous silicon photoconductive member.

11. An image forming apparatus comprising:

an image bearing member that bears an image;

image forming means for forming an image on said image bearing member;

transfer means for transferring the image from said image bearing member to a transfer material; and cleaning means including a cleaning blade, which that is abutted against a surface of said image bearing member for cleaning, said cleaning blade including at least a first rubber layer, which is abutted against said image bearing member, and a second rubber layer, which supports said first rubber layer, wherein a tanδ peak temperature obtained by a dynamic viscoelasticity test of said first rubber layer is a value close to a surface temperature of said image bearing member, and a tanδ peak temperature obtained by a dynamic viscoelasticity test of said second rubber layer is lower than the tan8 peak temperature of said first rubber layer.

12. An image forming apparatus according to claim 11, wherein said first rubber layer and said second rubber layer are made of polyurethane rubber.

13. An image forming apparatus according to claim 12, wherein a JIS-A hardness of said first rubber layer 5 and said second rubber layer is in a range of 40° to 90°.

14. An image forming apparatus according to claim 12, wherein JIS-A hardness of said first rubber layer and said second rubber layer is in a range of 50° to 80°.

15. An image forming apparatus according to claim 11, wherein said cleaning blade is made by integrally forming said first rubber layer with said second rubber layer.

16. An image forming apparatus according to claim 11, wherein said cleaning blade is made by bonding said first rubber layer and said second rubber layer.

17. An image forming apparatus according to claim 11, further comprising temperature control means for controlling the surface temperature of said image bearing member to a predetermined temperature.

18. An image forming apparatus according to claim 11, wherein the tanδ peak temperature of said first rubber layer is within ±5° C. of the surface temperature of said image bearing member.

19. An image forming apparatus according to claim 18, wherein a rubber material to make the tanδ peak temperature of said first rubber layer fall within ±5° C. of the surface temperature of said image bearing member is used in said first rubber layer.

20. An image forming apparatus according to claim 11, wherein said image bearing member is formed of an amorphous silicon photoconductive member.

21. A cleaning blade to be abutted against an image bearing member for bearing an image on a clean surface of the image bearing member, said cleaning blade comprising:

a first rubber layer to be disposed on a side of said cleaning blade to be abutted against the image bearing member, wherein a tanδ peak temperature obtained by a dynamic viscoelasticity test of said first rubber layer is a value close to a surface temperature of said image bearing member; and a second rubber layer that supports said first rubber layer, wherein a tanδ peak temperature obtained by a dynamic visceolasticity test of said second rubber layer is lower than the tanδ peak temperature of said first rubber layer.

22. A cleaning blade according to claim 21, wherein said first rubber layer and said second rubber layer are made of polyurethane rubber.

23. A cleaning blade according to claim 22, wherein a JIS-A hardness of said first rubber layer and said second rubber layer is in a range of 40° to 90°.

24. A cleaning blade according to claim 23, wherein a JIS-A hardness of a said first rubber layer and said second rubber layer is in a range of 50° to 80°.

25. A cleaning blade according to claim 21, wherein said cleaning blade is made by integrally forming said first rubber layer with said second rubber layer.

26. A cleaning blade according to claim 21, wherein said cleaning blade is made by bonding said first rubber layer and said second rubber layer.

27. A cleaning blade according to claim 21, wherein the tanδ peak temperature of said first rubber layer is within ±5° C. of the surface temperature of said image bearing member.

* * * * *

UNITED STATES PATENT AND TRADEMARK OFFICE

CERTIFICATE OF CORRECTION

PATENT NO. : 6,473,589 B2
DATED : October 29, 2002
INVENTOR(S) : Hisataka Hisakuni It is certified that error appears in the above-identified patent and that said Letters Patent is hereby corrected as shown below:

Title page,
Item [57], ABSTRACT,
Line 10, "tan δ" should read -- tanδ --.

Column 1,
Line 22, "is" (second occurrence) should read -- be --.

Column 2,
Line 63, "to" (first occurrence) should read -- from --.

Column 3,
Line 21, "member;" should read -- member; and --;
Line 22, "the" should read -- wherein the --; and
Line 38, "following" should read -- latter --.

Column 5,
Line 41, "is" should read -- be --;
Line 44, "mixture," should read -- mixtures, --;
Line 54, "so" should be deleted; and
Line 55, "as" should read -- so as --.

Column 6,
Line 9, "En)" should read -- E") --.

Column 7,
Line 18, "is" should read -- be --;

Column 8,
Line 57, "is" should read -- be --; and
Line 65, "is"(first occurrence) should read -- are --;

Column 9,
Line 44, "of" should be deleted.

Column 10,
Line 13, "following" should read -- latter --; and
Line 43, "a" (first occurrence) should read -- wherein a --.

UNITED STATES PATENT AND TRADEMARK OFFICE

CERTIFICATE OF CORRECTION

PATENT NO. : 6,473,589 B2
DATED : October 29, 2002
INVENTOR(S) : Hisataka Hisakuni It is certified that error appears in the above-identified patent and that said Letters Patent is hereby corrected as shown below:

Column 11,
Line 11, “on” should read -- borne on --;
Line 15, “which that” should read -- which --;
Line 26, “a” (first occurrence) should read -- wherein a --;
Line 28, “tan8” should -- tanδ --;
Line 33, “layer-5” should read -- layer --; and
Line 36, “JIS-A” should read -- a JIS-A --.

Column 12,
Line 25, “visceolasticity” should read -- viscoelasticity --.

Signed and Sealed this

Twenty-fourth Day of June, 2003

JAMES E. ROGAN
*Director of the United States Patent and Trademark Office*